United States Patent [19]

Francke

[11] Patent Number: 4,491,318

[45] Date of Patent: Jan. 1, 1985

[54] VARIABLE SPEED BALANCE OR TEETER BOARD

[76] Inventor: Amiel W. Francke, 2839 29th St. NW., Washington, D.C. 20015

[21] Appl. No.: 429,028

[22] Filed: Sep. 30, 1982

[51] Int. Cl.[3] ..... A63B 23/04

[52] U.S. Cl. ..... 272/146

[58] Field of Search ..... 272/114, 146, 1 E, 70, 272/33 A, 54, 55

[56] References Cited

U.S. PATENT DOCUMENTS

| | | | |
|---|---|---|---|
| 1,566,765 | 12/1925 | Natale | 272/54 |
| 1,850,927 | 3/1932 | Frederick | 272/55 |
| 1,866,906 | 7/1932 | Rager | 272/54 |
| 2,803,461 | 8/1957 | Coplin | 272/146 |
| 3,024,021 | 3/1962 | Coplin | 272/146 |
| 3,416,792 | 12/1968 | Morgan | 272/146 |
| 3,419,267 | 12/1968 | Stolle | 272/146 |
| 3,761,084 | 9/1973 | Dieckman | 272/146 |
| 3,887,179 | 6/1975 | Klepper | 272/1 E |
| 3,984,100 | 10/1976 | Firster | 272/146 |
| 4,279,415 | 7/1981 | Katz | 272/70 |

FOREIGN PATENT DOCUMENTS

| | | | |
|---|---|---|---|
| 7901529 | 8/1980 | Netherlands | 272/146 |
| 1372342 | 10/1974 | United Kingdom | 272/146 |

*Primary Examiner*—Richard J. Johnson

*Attorney, Agent, or Firm*—Shlesinger, Arkwright, Garvey & Fado

[57] ABSTRACT

A variable speed balance or teeter board including a platform, a fulcrum extending downwardly from the bottom of the platform into engagement with a supporting surface. The fulcrum comprising a variety of selectively used members of different shape and height for varying the angularity of the platform tilting action, and damping means comprising a plurality of members of different compressibility selectively or collectively interposed between the platform and the supporting surface for varying the speed of the tilting action of the platform upon application of unevenly distributed weight to the top of the platform, the particular damping member employed being dependent upon the ability of the individual using the balance board.

14 Claims, 7 Drawing Figures

FIG 1
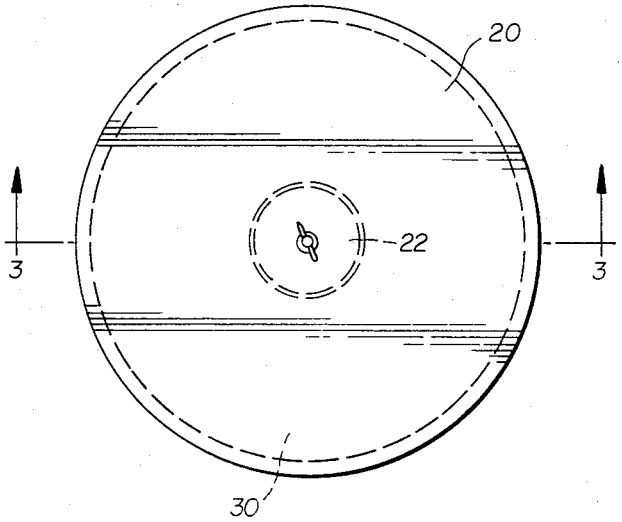
FIG 2
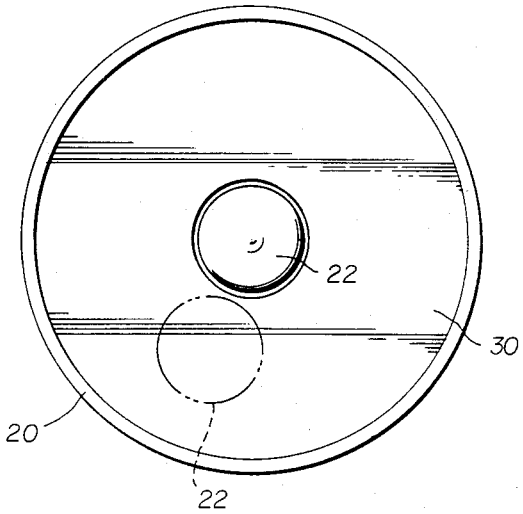
FIG 3
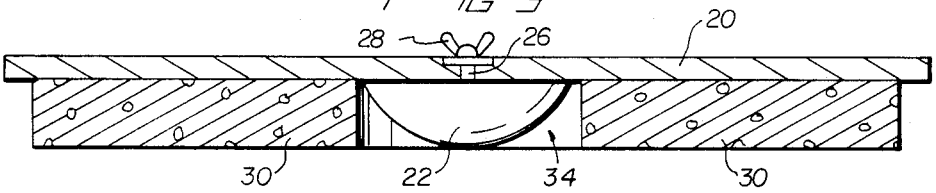
FIG 4
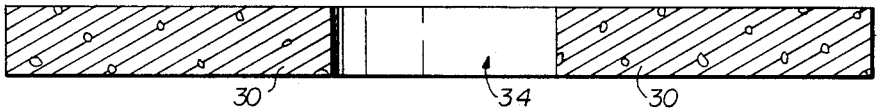
FIG 5
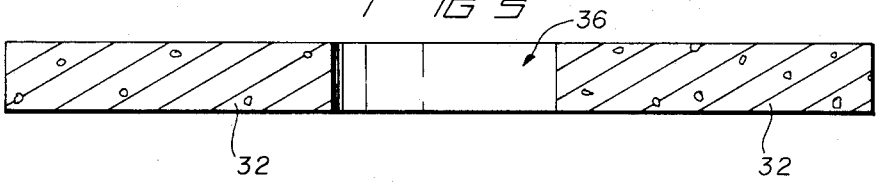
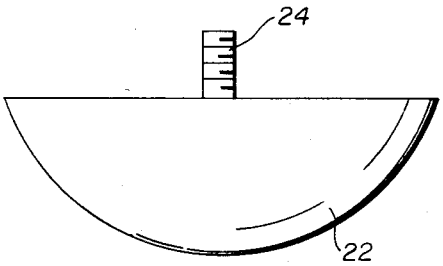
FIG 6
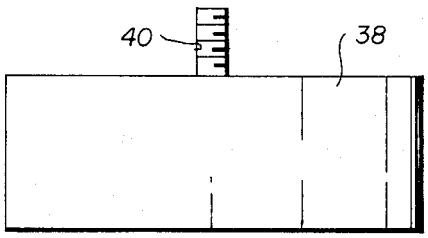
FIG 7

VARIABLE SPEED BALANCE OR TEETER BOARD

BACKGROUND OF THE INVENTION

This invention relates to a variable speed balance or teeter board for improving the balance of the user and for use as an exercising device.

A balance board generally comprises a platform having a fulcrum member connected to the bottom portion thereof, and serving as the fulcrum point for tilting movement of the platform. In use, the board is placed on a supporting surface, fulcrum side down. The user then mounts the platform in a standing or sitting position, or on hands or knees, and attempts to distribute his weight in such a manner that the platform does not tilt, but remains in a horizontal plane. This requires the user to exert equal effective pressure on opposite sides of the fulcrum member, since the effective pressure applied is the resultant, not only of the actual pressure applied by the parts of the body in contact with the board, but also of the distance of the contact points of the body from the fulcrum point, which changes the leverage effect.

Boards of this general type have also been in use as exercise devices for many years, and examples of such devices are illustrated in U.S. Pat. Nos. 2,803,461 issued Aug. 20, 1957 and 3,984,100 issued Oct. 5, 1976. U.S. Pat. No. 3,024,021 issued Mar. 6, 1962 discloses an exercise device including a platform supported by a ball, an elastic member being interposed between the platform and ball, so that the ball will tend to roll in any direction in which the weight of the user is shifted from the centered line of the ball. The elastic member tends to flex as the weight of the user is shifted, with the result that considerable skill is required to remain on the platform.

United Kingdom Pat. No. 1,372,342, published Oct. 3, 1974, discloses an exercising device of the balance board type, including a platform supported by a base, and having a coil spring interposed between the base and platform which provides a controlled resistance to rocking movement of the platform in any direction.

Although known devices of the balance board type for exercising or improving balance are useful for the average individual having little or no physical problems, they cannot be used by certain classes of persons having physical limitations. These include the handicapped, the retarded, physical rehabilitation patients, the elderly and any others who are not possessed of the requisite balance skills necessary for conventional balance and exercise boards.

SUMMARY OF THE INVENTION

The present invention is a balance or teeter board which is particularly adapted for use by individuals who have difficulty with their balance, and are therefore unable to use a conventional balance board. The present balance board is designed to control the speed and tilting angle of the platform on which the user stands, kneels or sits, the speed and angle of tilt being selectively changed to conform to the ability of the user. This invention is further designed to progressively improve the balance of the user by increasing the speed and tilting angle of the platform as the balancing skill of the user improves. The present balance board is also useful for exercising and strengthening the muscles of the same class of individuals using the balance board.

The balance board of the present invention includes a platform supported by a fulcrum member of selected height and shape, and a plurality of selectively improved damping members of compressible material interposed between the lower face of the platform and the supporting surface, to control the speed and tilting angle of the balance board platform when effective pressure is unequally distributed thereon relative to the fulcrum member. The damping members are of different compressibility in order to resist the downward movement of the platform in differing degrees, thereby varying the speed of tilt of the platform. The particular damping member used is dependent upon the ability of the user, a damping member which is only slightly compressible being initially used by those having severely impaired balance. More compressible damping members are employed as the balance of the user improves.

DESCRIPTION OF FIGURES OF THE DRAWINGS

FIG. 1 is a top plan view of the balance board of the present invention;

FIG. 2 is a bottom plan view thereof;

FIG. 3 is an enlarged sectional view taken along the line 3—3 of FIG. 1, looking in the direction of the arrows, portions thereof being shown in elevation;

FIG. 4 is a sectional view of a first damping member;

FIG. 5 is a view similar to FIG. 4 of a second damping member;

FIG. 6 is an elevational view of a fulcrum member forming a part of the present invention, and FIG. 7 is an elevational view similar to FIG. 6 of a modified form of the fulcrum member.

DESCRIPTION OF THE INVENTION

The balance board of the present invention comprises a platform 20 of any suitable rigid, sheet material, such as wood, plastic or metal. Platform 20 may be any desired shape, i.e. round, square, rectangular, propeller shape, etc., and may vary in size from a few inches to a few feet in width or circumference.

A fulcrum member 22 is secured in any suitable manner to one face of platform 20, either centrally as shown in full lines in FIG. 2, or eccentrically as shown in dotted lines. The eccentric locations of the fulcrum member greatly increases the difficulty of balancing on the board, and is for the use by an advanced performer who has mastered the concentric fulcrum member board. The fulcrum member may be fixedly engaged with the platform or, as shown in the drawing, may be removably secured thereto by suitable means, such as by a threaded shank 24 extending upwardly through a counter-sunk central opening 26 of platform 20, as shown to advantage in FIG. 3. A butterfly nut 28, or any other suitable fastening means is engaged with threaded shank 24 to removably secure the fulcrum member to the platform. This arrangement enables different shapes and sizes of fulcrum members to be employed with the platform in order to effect variation in the movement of platform 20. The ground engaging surface of fulcrum member 22 may be arcuate, as shown, or flat.

It is a salient feature of the present invention to provide two or more damping members for controlling the speed of tilt of platform 20, which damping members are shown to advantage in FIGS. 4 and 5, and are designated 30 and 32 respectively. As shown in FIGS. 1 to 3, damping members 30 and 32 are of approximately the same shape as platform 20, and are provided with openings 34 and 36 through which fulcrum member 22 passes for engagement with the supporting surface, which arrangement also serves to prevent relative movement between damping members 30 and 32 with respect to platform 20.

Members 30 and 32 may be of any suitable compressible material, each member being of a different density to vary the speed of tilting movement of the platform when effective weight is unequally distributed thereon with respect to the fulcrum point, the greater the density of the member, the slower the speed of the tilting platform.

In actual use, damping members made of foam rubber of different density, and approximately three to four inches in thickness, in conjunction with a fulcrum member of approximately hemi-spherical shape, have provided a balance board producing the desired action.

The manner of use of the balance board of the present invention is substantially the same as with a conventional balance board, with the exception that the appropriate damping member to be employed is initially selected for interpositioning between the platform and supporting surface. Although two damping members are illustrated in the drawing, it is to be understood that, if desired, any number of damping members of different compressibility, either singly or in combination, may be employed in order to obtain a greater range of movement by platform 20.

It will be noted that, with the present invention, no means are necessary for engaging or disengaging the selected damping member, the damping member being securely held in place by gravity and frictional engagement with platform 20 and the engagement of that portion surrounding the opening of the damping member with the fulcrum member.

The user of the balance board mounts the platform in conventional fashion and, depending upon the damping member selected to be placed between the platform and the supporting surface, the platform can move very quickly or very slowly. This enables the user to control the speed of the tilting action in accordance with his balancing ability and thereby enables him to use the board for extended periods of time.

The present balance board has also proven to be effective for use in strengthening weak legs and other parts of the body by the ability to provide appropriate resistance and appropriate speed of resistance by use of various damping members and various fulcrums.

As indicated, the fulcrum member forming a part of the present invention may be of a variety of sizes and shapes and that the platform may also be of a variety of sizes and shapes. By using different combinations of platforms and fulcrum members, a wide range of difficulty may be obtained in initiating the balancing procedure, the angle of tilt, the movement of the platform and ease of balancing.

In FIG. 7, there is illustrated a modified form of fulcrum member which is designated 38, which is of generally cylindrical shape, and having a threaded shank 40 extending from the upper end thereof. The lower flat side of fulcrum member 38 engages the supporting surface, and produces a different movement of the platform, as compared with the movement produced by the rounded hemi-spherical fulcrum member 22 illustrated in FIG. 6.

While there has been herein shown and described the presently preferred form of the present invention, it is to be understood that such has been done for purposes of illustration only, and that various changes may be made therein within the scope of the appended claims.

What is claimed is:

1. A balance board comprising:

(a) a platform of rigid sheet material;

(b) a fulcrum member secured to one face of said platform spaced a substantial distance from the periphery thereof and engaged with a supporting surface and adapted to permit parallel orientation of said platform with said supporting surface during use of the balance board, and, (c) damping means completely surrounding said fulcrum member disposed between said platform and the supporting surface, said damping means being in constant engagement with the supporting surface and substantially coextensive with said one face of the platform and extending substantially to the periphery thereof for controlling the speed of tilting of the platform when weight is unevenly distributed thereon.

2. The balance board of claim 1, wherein (a) said damping means is of compressible material which is substantially coextensive with the area of the platform.

3. The balance board of claim 2, wherein (a) said damping means includes a plurality of members of different compressibility selectively interposed between said platform and the supporting surface for varying the speed of tilt of the platform when unevenly distributed weight is placed thereon.

4. The balance board of claim 3, wherein (a) each of said compressible members has an opening through which said fulcrum member extends for engagement with the supporting surface.

5. The balance board of claim 4, wherein (a) that portion of said fulcrum member which engages the supporting surface is of arcuate shape.

6. The balance board of claim 4, wherein (a) that portion of said fulcrum member which engages the supporting surface is flat.

7. The balance board of claim 1, wherein (a) said fulcrum member comprises a plurality of members of different height and shape selectively secured to said platform.

8. A balance board comprising (a) a platform of rigid sheet material;

(b) a fulcrum member secured to one face of said platform spaced a substantial distance from the periphery thereof and engaged with a supporting surface and adapted to permit parallel orientation of said platform with said supporting surface during use of the balance board;

(c) a plurality of interchangeable damping members made of material having the characteristics of foam rubber and of different density selectively interchangeably interposed between, and in constant engagement with, said platform and the supporting surface for variably controlling the speed of movement and tilt of the platform when unevenly distributed weight is placed thereon; and, (d) each of said damping members being substantially coextensive with said platform and provided with an opening through which said fulcrum member passes.

9. The balance board of claim 8, with the addition of (a) a means for removably securing said fulcrum member to said platform.

10. The balance board of claim 9, wherein (a) said means includes an opening in said platform (b) a threaded shank extending upwardly from said fulcrum member into the opening of said platform, and (c) nut means engaged with said threaded shank for securing said fulcrum member to said platform.

11. The balance board of claim 8, wherein (a) that portion of said fulcrum member which engages the supporting surface is of arcuate shape.

12. The balance board of claim 8, wherein (a) that portion of said fulcrum member which engages the supporting surface is flat.

13. The balance board of claim 8, wherein (a) said fulcrum member is secured to the central portion of said platform.

14. The balance board of claim 8, wherein (a) said fulcrum member is eccentrically secured to said platform.

* * * * *